US005263805A

United States Patent [19]

Brizzi et al.

[11] Patent Number: 5,263,805

[45] Date of Patent: Nov. 23, 1993

[54] SYSTEM FOR SUPPLYING ROD-SHAP ITEMS, SUCH AS CIGARETTES, TO A PRODUCTION MACHINE

[75] Inventors: Marco Brizzi, Zola Predosa; Antonio Gamberini, Bologna, both of Italy

[73] Assignee: G.D. S.p.A., Bologna, Italy

[21] Appl. No.: 870,816

[22] Filed: Apr. 20, 1992

[30] Foreign Application Priority Data

Apr. 23, 1991 [IT] Italy ..... BO91A000132

[51] Int. Cl.[5] ..... B65G 67/02

[52] U.S. Cl. ..... 414/391; 414/399; 414/401; 414/421; 414/609

[58] Field of Search ..... 414/391, 399, 401, 419, 414/421, 609; 198/468.8

[56] References Cited

U.S. PATENT DOCUMENTS

| | | | |
|---|---|---|---|
| 3,332,560 | 7/1967 | Niepmann | 414/421 X |
| 3,718,224 | 2/1973 | Hillman | 414/419 |
| 3,883,017 | 5/1975 | Shirai et al. | 414/421 X |
| 4,029,221 | 6/1977 | Nakai et al. | 414/401 |
| 4,039,090 | 8/1977 | Desourdy | 414/391 X |
| 4,319,861 | 3/1982 | Seragnoli | 414/419 |
| 4,423,996 | 1/1984 | Applegate et al. | 414/391 |
| 4,549,842 | 10/1985 | Tidmarsh | 414/391 |
| 4,640,656 | 2/1987 | Mattei | 414/419 X |
| 4,696,617 | 9/1987 | Kumata et al. | 414/421 X |
| 5,007,522 | 4/1991 | Focke et al. | 414/391 X |
| 5,064,331 | 11/1991 | Yamaguchi et al. | 414/391 X |

*Primary Examiner*—David A. Bucci

*Attorney, Agent, or Firm*—Cushman, Darby & Cushman

[57] ABSTRACT

Cigarettes are supplied to a packaging machine by equipment comprising an infeed hopper into which the cigarettes are supplied in bulk, a rotating head providing at least one compartment to accommodate a tote-box type container filled with cigarettes, from which the contents of successive containers are directed toward the hopper, and a passage directly beneath the rotating head admitting a succession of trucks each carrying several of the containers spaced apart at identical distance; the truck is propelled forward intermittently by a drive system, proceeding in discrete steps equal to the distance between centers of the containers in such a way that an elevator can operate during the pauses to shuttle the full and empty containers to and from the head.

10 Claims, 2 Drawing Sheets

SYSTEM FOR SUPPLYING ROD-SHAP ITEMS, SUCH AS CIGARETTES, TO A PRODUCTION MACHINE

BACKGROUND of the INVENTION

The present invention relates to equipment used in supplying items of rod-like shape, such as cigarettes, to a production machine. In particular, the invention relates to equipment designed to bring about the transfer of cigarettes from containers of substantially parallelepiped shape (tote boxes) carried on special trucks, to the infeed hopper of a packaging machine. The prior art, as represented by U.S. Pat. No. 4,029,221 for example, embraces the expedient of conveying a plurality of such boxes into a position alongside the packaging machine, by means of trucks, and then, in a sequence of movements brought about automatically along horizontal and vertical axes, transferring the boxes in succession to a tilting head by which the cigarettes occupying the boxes are dropped into the infeed hopper.

To arrange the trucks alongside, a packaging machine in such a way that the boxes can be transferred singly and in succession, it follows that there has to be a generous amount of free space near the machine in which to accommodate the trucks. Given that such space could be exploited more profitably, however, the use of the trucks in this manner is quite disadvantageous.

Moreover, with the need to carry the boxes through both horizontal and vertical trajectories, systems of the type outlined above tend to be complicated and costly.

The object of the present invention is to achieve greater simplicity and economy of construction in equipment of the type at hand, and to provide such system which also conserves manufacturing in space compared to prior art embodiments.

SUMMARY of the INVENTION

The stated object is realized by the system of the present invention. The system serves to supply items of rod-like appearance (for example cigarettes) to a production machine, and comprises a hopper to which the items are supplied in bulk and which constitutes the infeed station of the production machine, a feeder by which the items are directed in bulk toward the hopper, a chamber from which the items are directed in bulk into the end of the feeder remote from the hopper, and a rotating head affording at least one compartment able to accommodate one of a plurality of single containers filled with the items. The containers are carried initially by a truck and spaced apart at equal distances on the truck. The function of the truck is to overturn the single containers and deposit their contents in the chamber.

The system further comprises a passage situated directly beneath the rotating head, for the accommodation of the truck, means by which to propel the truck through a succession of discrete steps equal in length to the distance between centers of the containers carried by the truck, and an elevator device comprising conveyor means by which the containers are shuttled in succession through a substantially vertical path between the truck and the rotating head.

BRIEF DESCRIPTION of the DRAWINGS

The invention will now be described in detail, by way of example, with the aid of the accompanying drawings, in which.

DESCRIPTION of the PREFERRED EMBODIMENTS

Figure 1:
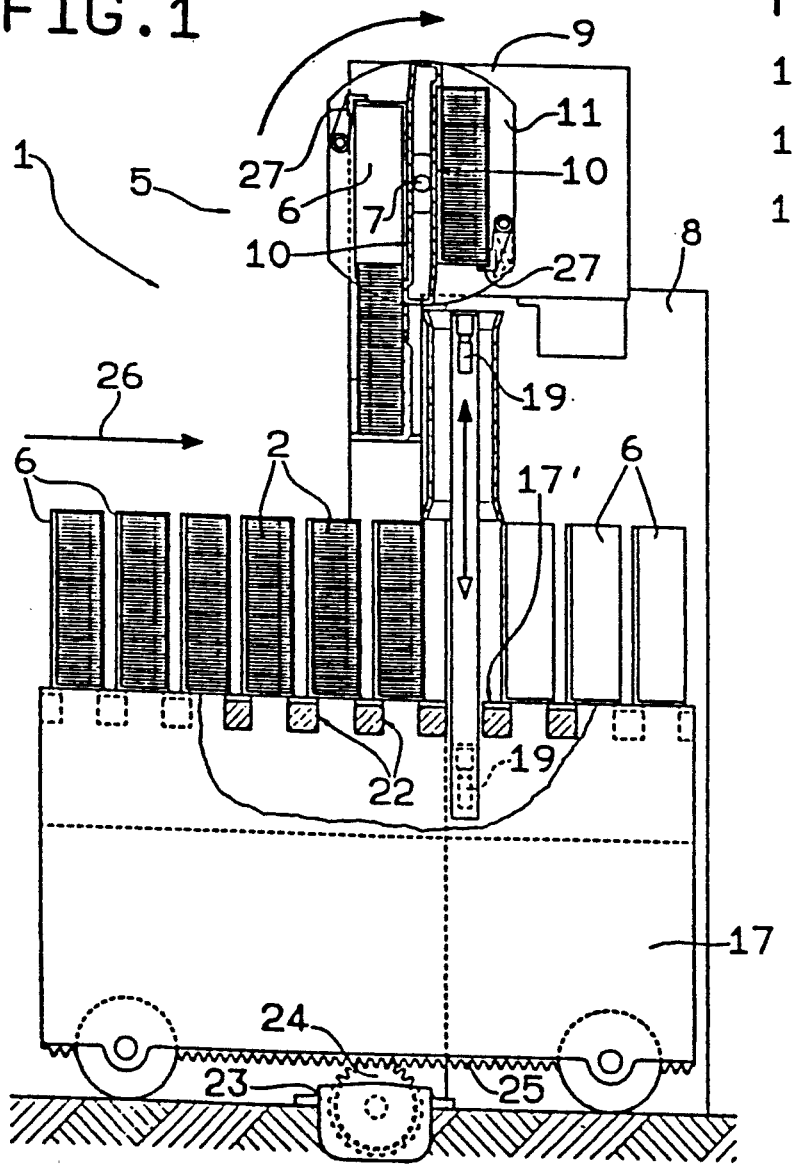
FIG. 1 is the schematic illustration of equipment for feeding items of rod-like appearance, as embodied according to the present invention, viewed in side elevation.
Figure 2:
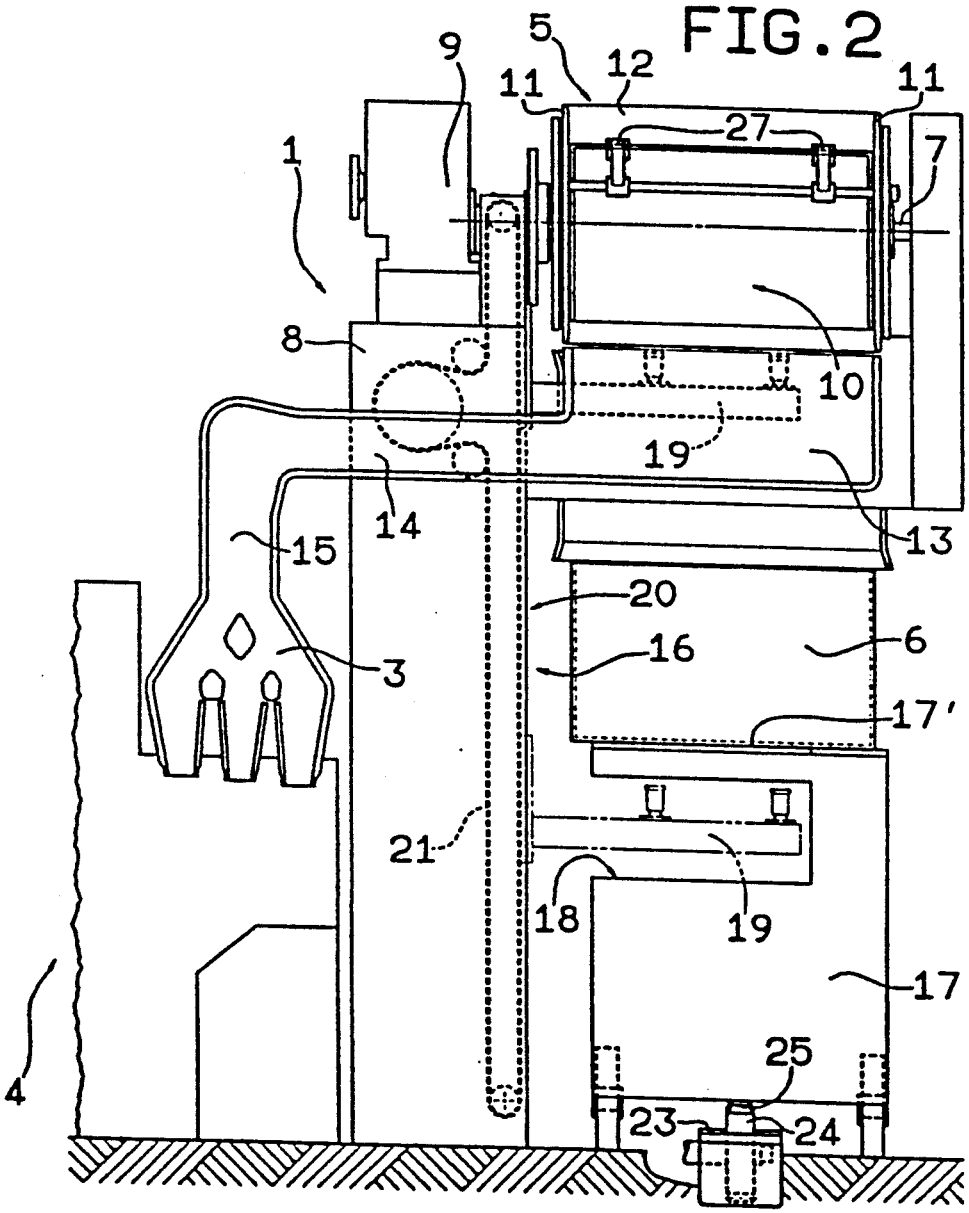
FIG. 2 shows the equipment of FIG. 1 in a frontal elevation.

Referring particularly to FIGS. 1 and 2 of the accompanying drawings, 1 denotes a complete system by which rod-shaped items such as cigarettes 2, are supplied to the infeed hopper 3 of a production machine, which might be a packaging machine 4.

The system 1 comprises transfer or transfer head 5, which operates to support and overturn a succession of containers 6 filled with the cigarettes 2.

Figure 3:
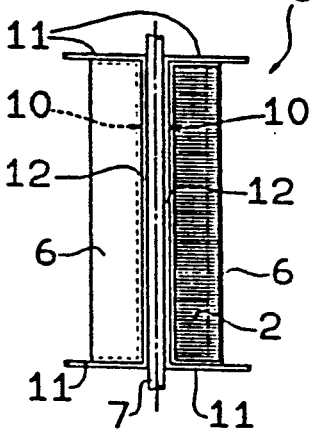
FIG. 3 is a detail of the equipment of FIGS. 1 and 2 shown in plan view.

As discernible also from FIG. 1, the transfer head 5 is carried on a horizontal shaft 7 supported by the frame 8 of the packaging machine 4 and connected to intermittent drive means 9, of conventional embodiment, by which the shaft 7 is indexed 180° about its own axis at determined intervals. The head 5 will be seen from FIG. 3 to provide two opposing compartments 10, open at top and bottom. Each of the compartments 10 are able to accept one container 6 and has two vertical side walls 11 disposed normal to the shaft 7. A third inside or back wall 12 is positioned adjacent to the shaft 7 and disposed normal to the side walls 11.

12 denotes a receiving chamber positioned beneath one of the two compartments 10 of the head 5, into which the cigarettes 2 are directed. The chamber 13 is connected on one side with a horizontally disposed channel or feeder device 14, shown schematically in FIG. 2 as a fixed duct of which the left hand end is connected with a vertical duct 15 emerging into the hopper 3.

16 denotes a passage located beneath the head 5, through which a succession of trucks 17 is directed. Each truck has a horizontal 17′ affording support to a plurality of containers 6 arranged side by side. As will become clear in due course, all the containers 6 occupying one truck 17 on its arrival in the passage 16 are full of cigarettes 2. As successive full containers are removed from the truck 17 and overturned by the transfer head 5, the same containers are returned empty to the truck 17 one by one.

As illustrated in FIG. 2, the side of the truck 17 directed toward the packaging machine 4 affords a recess 18, serving to accommodate a projecting element or arm 19 that forms part of an elevator device 20. The elevation device is mounted to the frame 8 of the machine 4 and is capable of movement in a vertical direction. More exactly, the elevator device 20 comprises a vertically disposed chain conveyor 21, with which the elevating arm 19 is rigidly associated, secured to the frame 8 and set in forward or reverse motion as appropriate by drive means not illustrated in the drawings.

The deck 17′ of the truck 17 (see FIG. 1) affords a plurality of gaps 22, one beneath each container 6, through which the elevating arm 19 is able to pass vertically from one side of the deck 17' to the other.

When occupying the passage 16 next to the packaging machine 4, the truck 17 is positioned directly over propulsion means comprising a drive unit denoted 23 of which a projecting gear 24 engages in mesh with a rack 25 rigidly attached to the bottom of each truck 17. As will become clear in due course, such means serve to propel the trucks 17 lying alongside the machine 4 in a direction normal to the axis of the shaft 7, through a succession of discrete steps substantially equal to the distance between centers of the containers 6 standing on each truck 17. In operation, with the elevating arm 19 positioned in readiness by the chain conveyor 21 at the height of the recess 18, a truck 17 can be stationed in the passage 16 with one of the containers 6, which is the leading container considered in the direction of propulsion (indicated by the arrow denoted 26), directly above the arm 19.

The chain conveyor 21 now raises the arm 19, which in passing through the corresponding gap 22 engages and directs the container 6 upward toward an empty compartment 10 of the transfer head 5. Once the container 6 is fully elevated, an actuator means of conventional embodiment (not illustrated) operates to engage a locking device 27, also conventional, by which the container is restrained internally of the compartment 10.

In the meantime, another container 6 already occupying the head 5 will be in the process of emptying, and once all the cigarettes 2 have been deposited in the chamber 13, the head 5 is indexed by the drive means 9 such that the next container 6 is introduced into the opposite compartment 10 and overturned and positioned above the chamber 13.

The locking device 27 restraining the empty container 6 is then released, whereupon the arm 19 descends to the recess 18, thus returning the empty container 6 to the position occupied on the deck 17', before its ascent to the head 5. At this point, the drive unit 23 of the propulsion means moves the truck 17 forward, by interaction of the gear 24 and the rack 25, to a position whereby the next full container 6 in line is brought into vertical alignment with the elevating arm 19. Thereafter, the same sequence of steps is repeated so as to direct each full container 6 up into the head 5, until all the containers 6 carried by the truck 17 have been emptied. At such time the truck 17 is removed from the passage 16 and replaced by another truck carrying more full containers 6. It will be seen from the foregoing description of the system 1 disclosed, that the stated object is fully realized. That is with the trucks 17 passing directly beneath the transfer head 5, significantly compact dimensions are achieved. Moreover, with no device other than the elevating arm 19 employed in shuttling the containers 6 to and from the head 5, the system 1 is rendered simple and economic in construction.

What is claimed is:

1. A system for supplying rod-shaped items to a production machine, comprising:

a hopper to which the rod-shaped items can be supplied, said hopper being operable as an infeed station of the production machine;

a feeder for directing the rod-shaped items toward the hopper;

a chamber from which the rod-shaped items are directed by the feeder toward the hopper;

a truck for carrying a plurality of containers in equally spaced relation from one another, said containers for initially holding the rod-shaped items, a rotatable head having at least one compartment for successively receiving at least one of said containers from said truck and operable to transfer the rod-shaped items from the at least one of said containers into the chamber;

a passage disposed below the rotatable head and serving to accommodate the truck;

means for propelling the truck through a successive of discrete distances equal in length to a distance between centers of the containers carried by the truck; and an elevator device comprising conveyor means for shuttling each of the containers in succession through a substantially vertical path between the truck and the rotatable head.

2. The system as in claim 1, wherein the truck further comprises a deck designed to support the plurality of containers, and a gap beneath each container providing a passage for the conveyor means of the elevator device.

3. Equipment as in claim 1, wherein each compartment of the rotatable head comprises an open top and an open bottom.

4. Equipment as in claim 2, wherein each compartment of the rotatable head comprises an open top and an open bottom.

5. The system as claimed in claim 1, wherein the production machine comprises a packaging machine.

6. A device for transferring rod-shaped items comprising:

a hopper to which the rod-shaped items can be supplied;

a feeder for directing the rod-shaped items toward the hopper;

a chamber from which the rod-shaped items are directed by the feeder toward the hopper;

a truck for carrying a plurality of containers in equally spaced relation from one another, said containers for initially carrying the rod-shaped items therein;

a rotatable head for successively receiving each of said containers carrying the rod-shaped items from said truck and operable to transfer the rod-shaped items from the containers into the chamber;

an elevator device for successively shuttling each of the containers through a substantially vertical path from the truck to the rotatable head and from the rotatable head back to the truck;

a passage disposed below the rotatable head for accommodating said truck; and means for propelling the truck through said passage.

7. The system as in claim 6, wherein the truck further comprises a deck designed to support the containers and a gap beneath each container providing a passage for the elevator device.

8. The system as in claim 6, wherein the rotatable head has at least one compartment into which the containers are received.

9. The system as in claim 8, wherein each compartment of the rotatable head comprises an open top and an open bottom.

10. The system as in claim 7, wherein the rotatable head has at least one compartment into which the container are received, each said at least one compartment having an open top and an open bottom.

* * * * *